US005905341A

United States Patent [19]

Ikeuchi et al.

[11] Patent Number: 5,905,341

[45] Date of Patent: May 18, 1999

[54] HIGH PRESSURE MERCURY ULTRAVIOLET LAMP

[75] Inventors: Mitsuru Ikeuchi; Yukihiro Morimoto; Hiromitsu Matsuno, all of Himej, Japan

[73] Assignee: Ushiodenki Kabushiki Kaisha, Tokyo, Japan

[21] Appl. No.: 08/946,096

[22] Filed: Oct. 7, 1997

[30] Foreign Application Priority Data

Oct. 7, 1996 [JP] Japan ..... 8-282864

[51] Int. Cl.[6] ..... H01J 61/22

[52] U.S. Cl. ..... 313/639; 313/640; 313/636

[58] Field of Search ..... 313/639, 640, 313/641, 642, 638, 571, 25, 636; 445/26

[56] References Cited

U.S. PATENT DOCUMENTS

| | | | |
|---|---|---|---|
| 3,786,297 | 1/1974 | Zollweg et al. | 313/641 |
| 3,911,308 | 10/1975 | Akutsu et al. | 313/642 |
| 4,074,164 | 2/1978 | Leyendecker | 313/25 |
| 5,694,002 | 12/1997 | Krasko et al. | 313/641 |

OTHER PUBLICATIONS

Thermodynamic Properties of NaI–$DyI_3$ System in Melts And Saturated Vapours, Proceeding of the Symposium On High Temperature Lamp Chemistry II, O. Kaposi et al., vol. 88–4, pp. 70–89(No Month).

*Primary Examiner*—Sandra O'Shea
*Assistant Examiner*—Michael Day
*Attorney, Agent, or Firm*—Sixbey, Friedman, Leedom & Ferguson; David S. Safran

[57] ABSTRACT

A high pressure mercury ultraviolet lamp with high dimensional accuracy in which the emitter material during lamp operation is prevented from spraying and being deposited on the wall of the discharge vessel and the UV radiation transmission factor is prevented from being reduced is achieved by the fact that at least one of a group of halides which consists of halides of yttrium, lanthanum, cerium, dysprosium, gadolinium and thorium and at least one of a group of halides which consists of halides of alkali metal elements are filled at a filling ratio in the range from 1:4 to 1:20 to one another as a molar fraction. This also yields the same action as the application of emitter material to the upholding parts of the electrodes. Furthermore, high dimensional accuracy can be ensured by the measure by which the discharge vessel is made of a translucent ceramic, such as YAG.

19 Claims, 6 Drawing Sheets

HIGH PRESSURE MERCURY ULTRAVIOLET LAMP

BACKGROUND OF THE INVENTION

1. Field of the invention

The invention relates to a high pressure mercury ultraviolet lamp which is used for a light source of a UV curing device and the like.

2. Description of Related Art

In a conventional high pressure mercury ultraviolet lamp, to facilitate discharge, on the tips of the upholding parts of the electrodes there are usually double or triple coils to which emitter material of barium oxide or the like is applied. However, this emitter material heats up during operation of the lamp within the discharge vessel and sprays onto the walls of the discharge vessel where it adheres, causing the UV radiation transmission factor of the wall of this discharge vessel to be reduced. As a result, the light output necessary for treatments using UV radiation is reduced and the service life of the lamp is shortened.

Recently, together with the advancing reduction in the size of devices which have UV lamps, the lamps continue to shrink. In high pressure mercury ultraviolet lamps of the short arc type with an inside volume of greater than or equal to roughly 2.5 $cm^3$ the above described arrangement in which the emitter material is applied to the electrodes is used in practice. However, in high pressure mercury ultraviolet lamps with smaller dimensions, the application of the emitter material to the upholding parts of the electrodes entails difficulties with respect to the arrangement. For smaller high pressure mercury ultraviolet lamps, due to the smaller area of the inside wall of the discharge vessel, even if the emitter material can be applied to the upholding parts of the electrodes, the above described spraying of emitter material onto the wall surface has a great effect on the reduction of the amount of light.

The emitter material which is deposited on the wall of the discharge vessel, especially in the case of using UV radiation with wavelengths of less than or equal to 400 nm, has a higher absorption factor for light in the UV range with short wavelengths than for light in the range of visible radiation. The effect of deposition of the layer onto the wall of the discharge vessel by the spraying of emitter material is therefore very great. Furthermore, in the case of an inside volume of the discharge vessel of less than or equal to 2.5 $cm^3$ it is difficult to obtain dimensional accuracy.

SUMMARY OF THE INVENTION

Therefore, a first object of the present invention is to devise a high pressure mercury ultraviolet lamp with a discharge vessel which has an inside volume that is less than or equal to 2.5 $cm^3$, but in which emitter material is not applied to the upholding parts of the electrodes and in which, during lamp operation, the emitter material is prevented from spraying and adhering to the wall of the discharge vessel, reducing the UV radiation transmission factor and shortening the service life.

A second object of the invention is to devise a high pressure mercury ultraviolet lamp which has a smaller shape and high dimensional accuracy.

These objects are achieved in a high pressure mercury ultraviolet lamp according to the invention, in which a small discharge vessel with an inside volume of less than or equal to 2.5 $cm^3$ contains a pair of electrodes and mercury as the primary emission component, by the fact that at least one halide which is chosen from a first group of halides which consists of halides of yttrium, lanthanum, cerium, dysprosium, gadolinium and thorium and at least one halide chosen from a second group of halides which consists of halides of alkali metal elements, so that at least one halide of the above described first group acts as an emitter material, are filled at a filling ratio in the range from 1:4 to 1:20 relative to one another as a molar fraction, and that the average evaluation index of color reproduction is fixed at less than or equal to 40.

For a small high pressure mercury ultraviolet lamp, this yields the same function as the application of emitter material to the upholding parts of the electrodes. Furthermore, spraying of the emitter material during lamp operation is prevented.

The above described effect is, furthermore, achieved more advantageously when at least one halide of the first group and at least one halide of the second group are filled at a filling ratio of 1:5 to 1:20 relative to one another as a molar fraction.

The above objects are also advantageously achieved in the high pressure mercury ultraviolet lamp by the above described discharge vessel being made of a translucent ceramic. This measure makes it possible to ensure dimensional accuracy in a high pressure mercury ultraviolet lamp which is smaller than one of quartz glass.

Furthermore, the objects of the present invention are advantageously achieved in the high pressure mercury ultraviolet lamp by fixing a value which is obtained by dividing the emission intensity of the spectral line of dysprosium atoms with a wavelength of 422.5 nm by the emission intensity of mercury atoms with a wavelength of 404.6 nm in a steady state at less than or equal to 0.25, when a halide of dysprosium is chosen as the specific first halide.

Additionally, the objects of the invention are advantageously achieved by fixing the value which is obtained by dividing the emission intensity of the spectral line of the lanthanum atoms with a wavelength of 406.0 nm by the emission intensity of the mercury atoms with a wavelength of 404.6 nm in a steady state at less than or equal to 0.1, when a halide of lanthanum is chosen as the specific first halide.

The objects of the invention are, furthermore, advantageously achieved in the high pressure mercury ultraviolet lamp by fixing the value which is obtained by dividing the emission intensity of the spectral line of gadolinium atoms with a wavelength of 402.8 nm by the emission intensity of the mercury atoms with a wavelength of 404.6 nm in a steady state at less than or equal to 0.15, when a halide of gadolinium is chosen as the specific first halide.

Still further, the objects of the invention are advantageously achieved by fixing the value which is obtained by dividing the emission intensity of the spectral line of cerium atoms with a wavelength of 397.2 nm by the emission intensity of mercury atoms with a wavelength of 404.6 nm in a steady state at less than or equal to 0.1, when a halide of cerium is chosen as the specific first halide.

The objects of the invention are also advantageously achieved by fixing the value which is obtained by dividing the emission intensity of the spectral line of yttrium atoms with a wavelength of 410.2 nm by the emission intensity of mercury atoms with a wavelength of 404.6 mn in a steady state at less than or equal to 0.15, when a halide of yttrium is chosen as the specific first halide.

The objects of the invention are, furthermore, advantageously achieved by fixing the value which is obtained by dividing the emission intensity of the spectral line of thorium atoms with a wavelength of 408.5 nm by the emission intensity of mercury atoms with a wavelength of 404.6 nm in a steady state at less than or equal to 0.2, when a halide of thorium is chosen as the specific first halide.

Furthermore, in the above described high pressure mercury ultraviolet lamp, the objects of the invention are advantageously achieved by fixing the current density in the steady operating state in the range from 3 $A/mm^2$ to 15 $A/mm^2$ when the value obtained by dividing the lamp current by a cross sectional area in the direction perpendicular to the axial direction of the upholding parts of the electrodes is called the current density. This measure can increase the service life of the lamp.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 2:
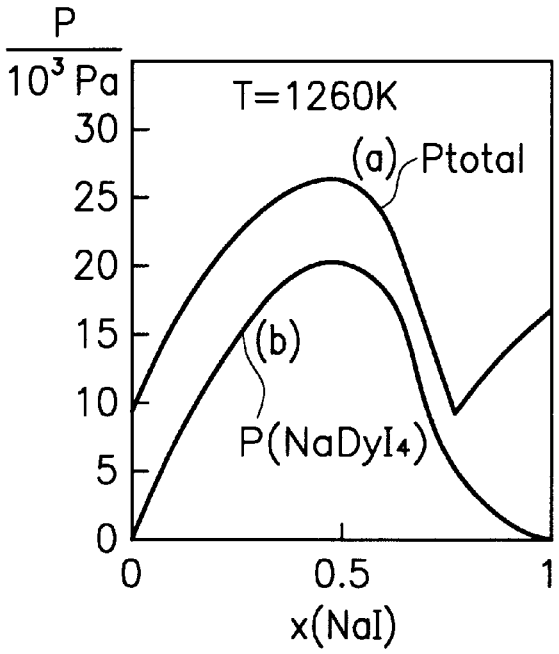
FIG. 2 shows a graph depicting the thermodynamic activity of the sodium iodide and dysprosium iodide.
Figure 3:
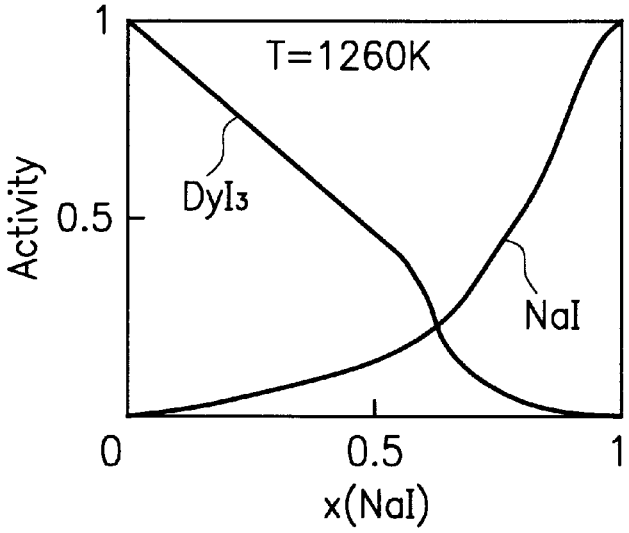
FIG. 3 is a plot of the vapor pressure curves of sodium iodide and dysprosium iodide at 1260 K.

FIGS. 2 and 3 show the relationships between the vapor pressure and the activity of the halide of the first group, i.e., halides of yttrium, lanthanum, cerium, dysprosium, gadolinium and thorium, and the halide of the second group, i.e., halides of alkali metal elements, from a known publication. Here, examples are shown in which dysprosium iodide was used as the first halide and sodium iodide was used as the second halide. These figures show states at a temperature of 1260° K., which is in the vicinity of the temperature of the coolest part within the discharge vessel when a lamp is operating.

In FIG. 3, the activity of the dysprosium iodide decreases quickly in the range with a high molar fraction of sodium iodide. In the area of the point of intersection of the two lines, $NaDyI_4$ as a combined compound, dysprosium iodide and sodium iodide are present. In FIG. 2, the upper curve (a) represents the total pressure of all vapor phases. Furthermore, in FIG. 2 the lower curve (b) represents the vapor pressure curve of $NaDyI_4$. It becomes apparent from this drawing that the vapor pressure of $NaDyI_4$ decreases rapidly in the range with a high molar fraction of sodium iodide, i.e., it no longer easily vaporizes.

Figure 4:
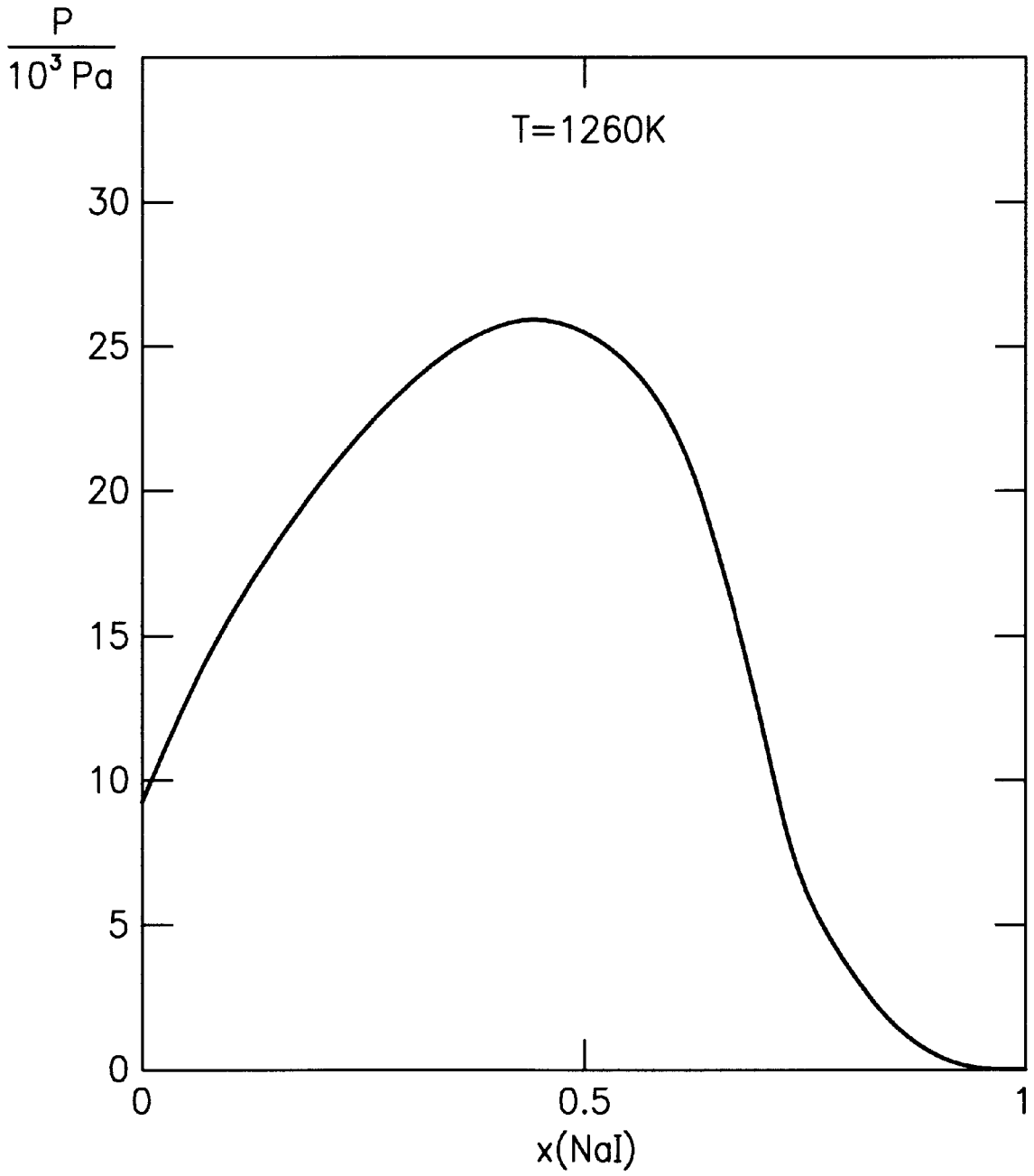
FIG. 4 is a graph showing the vapor pressure curve of dysprosium iodide and the combined compound $NaDyI_4$ at 1260 K.

The total density of the dysprosium atoms active in the gaseous phase follows from the addition of the density of the dysprosium atoms in the $NaDyI_4$ and the $DyI_3$ phase. FIG. 4 illustrates this curve which is composed of the vapor pressure curves of $NaDyI_4$ and $DyI_3$ and which corresponds to the combination of FIGS. 2 and 3.

The idea underlying the high pressure ultraviolet lamp of the present invention lies, according to FIG. 4, in monitoring the vapor pressure of dysprosium in the gaseous phase, and thus, monitoring its density and keeping it low, so that there is no contribution to emission, by using halides as filling substances which are combined with a mixing ratio in the range in which a large amount of a sodium halide is present. Therefore, there is mainly emission of mercury and an ultraviolet lamp can be devised with an evaluation index of color reproduction less than or equal to 40.

In the above described lamp the following can be presented:

When filling with sodium iodide, which is a halide which has been chosen from the halides of the second group, which consists of halides of alkali metal elements, due to its relatively high vapor pressure, this halide penetrates in the form of a liquid into a gap which is formed between the wall of the discharge vessel which is the coolest part within the discharge vessel and the base points of the electrodes. It fills this gap and has the function of substantially increasing the temperature of the discharge space. This increases the temperature of the coolest part within the discharge vessel with which the vapor of the first halide comes into contact. The halide of the first group with a low vapor pressure thus vaporizes more easily and is decomposed by vaporization. For this reason, the metal of the halide is adsorbed by the electrodes.

The dysprosium which forms a halide of the first group has a low work function. By its adsorption to the electrode tips, therefore, the work function decreases in the electrode tip areas. Consequently, thermal electron emissions from the electrode tip areas increase and the electrode temperature drops. This means that the halide of the first group functions as an emitter material. The dysprosium which, after adsorption to the electrodes, is vaporized again from the electrodes and again binds to the halogen atoms, becomes a halide and is used again, by which deposition of the film onto the wall of the discharge vessel and reduction of the UV transmission factor are prevented. The dysprosium is adsorbed by the electrode tips and functions as the emitter.

As was described above, the halide of sodium of the second group enables the dysprosium halide to act as an emitter material. The halide of the second group furthermore contributes to stabilization of the arc during discharge.

In the aforementioned description, dysprosium iodide was chosen as the halide of the first group and sodium iodide was chosen as the halide of the second group which consists of halides of alkali metal elements. The thermodynamic state within the discharge vessel in the operating state is, however, the same as in the dysprosium iodide—sodium iodide line, even if, instead of or besides the halide of dysprosium, at least one halide of yttrium, lanthanum, cerium, gadolinium or thorium is chosen as the halide of the first group; a halide of the alkali metal elements lithium, potassium, rubidium, cesium and the like may be chosen as the halide of an alkali metal element, instead of or besides the halide of sodium, in a suitable manner, combined with one another, and the discharge vessel filled therewith. It is also possible to choose the filling ratio of the at least one halide of the first group to the at least one halide of the second group as a molar fraction in the range in which the molar fraction of at least one halide of the second group is high, and by filling thereof, the at least one halide of the first group, during lamp operation, does not contribute to emission, and it acts as an emitter material.

Figure 1:
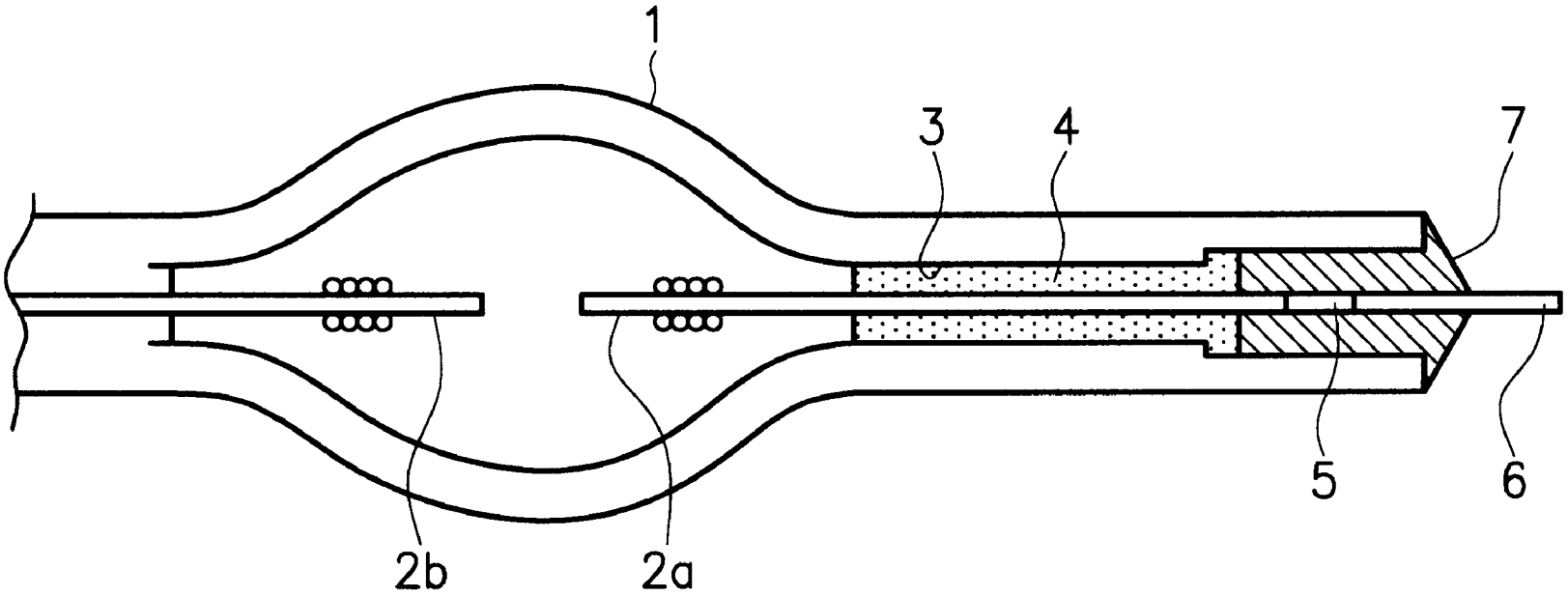
FIG. 1 is a schematic cross-sectional view of a high pressure mercury ultraviolet lamp according to the invention.

In one embodiment, dysprosium iodide was used as the halide of the first group and cesium iodide was used as the halide of the second group. A high pressure mercury ultraviolet lamp according to the invention was produced using the arrangement of FIG. 1 under the following conditions:

(Arc tube 1)

Dimensions: Outside diameter 4.0 mm

Inside diameter 3.0 mm (thickness 0.5 mm)

Material: poly-crystalline yttrium . aluminum . gamet (YAG)

Inside volume: 0.025 $cm^3$ (Electrodes (2*a,* 2*b*))

Dimensions: Length of extension within the discharge vessel 1.0 mm

Diameter 0.3 mm

Material: tungsten

Distance between electrodes: 1.0 mm (Material to be filled)

Gas to be filled: Ar 300 torr

Mercury: 0.9 mg

Cesium iodide: 2.6 mg

Dysprosium iodide: 0.25 mg

Within the YAG arc tube 1, a hermetically sealed portion is joined to inside wall surface 3 of the hermetically sealed portion by wrapping the tungsten rod of the electrode with an aluminum oxide ceramic material 4. The hermetically sealed portion is, furthermore, joined within an area on its end via niobium wire 5 to platinum line 6, the end of the hermetically sealed portion being hermetically sealed by means of frit glass 7. The lamp was operated under illumination conditions of a lamp current of 0.5 A and lamp wattage of 15 W.

Figure 5:
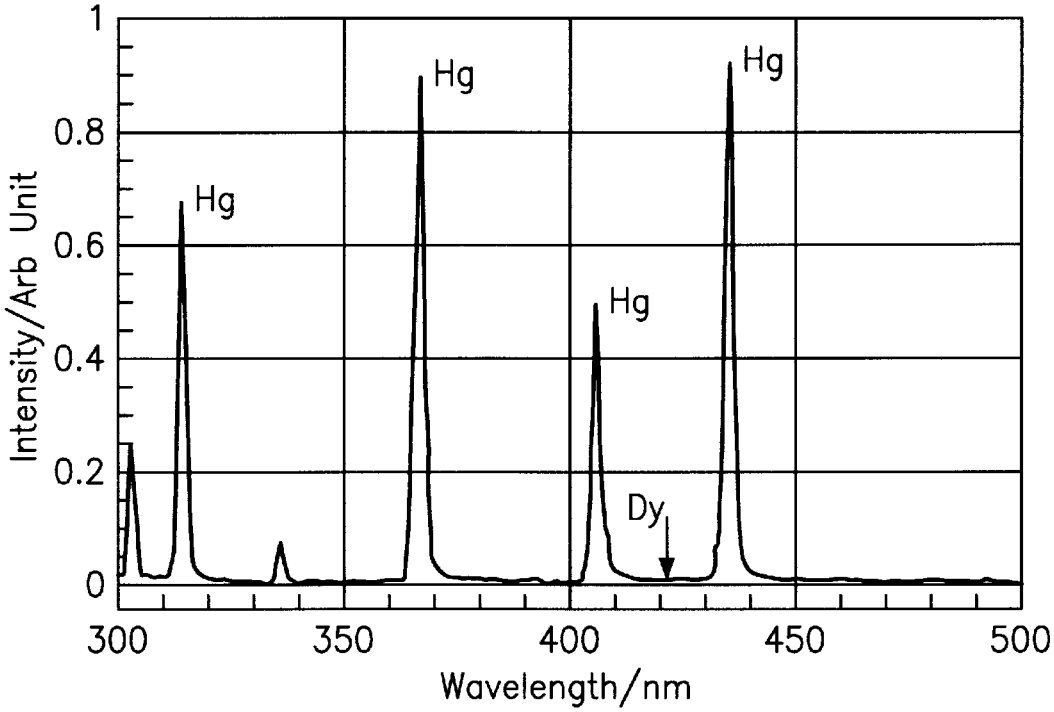
FIG. 5 shows an example of the spectrum of a high pressure mercury ultraviolet lamp in accordance with the invention.

FIG. 5 schematically shows the emission spectrum of the high pressure mercury ultraviolet lamp in this embodiment in which dysprosium iodide and cesium iodide with a molar fraction ratio of 1:10 relative to one another are filled. Controlling the filling amount of dysprosium iodide as the halide of the first group suppresses the emission peak of dysprosium and the average index of color reproduction is 25. This is shown by the result that the emission ratio of the ultraviolet radiation of a wavelength less than or equal to 400 nm relative to the emission in the visible range of the lamp became greater, so that a high pressure mercury ultraviolet lamp with high efficiency was obtained.

Figure 7:
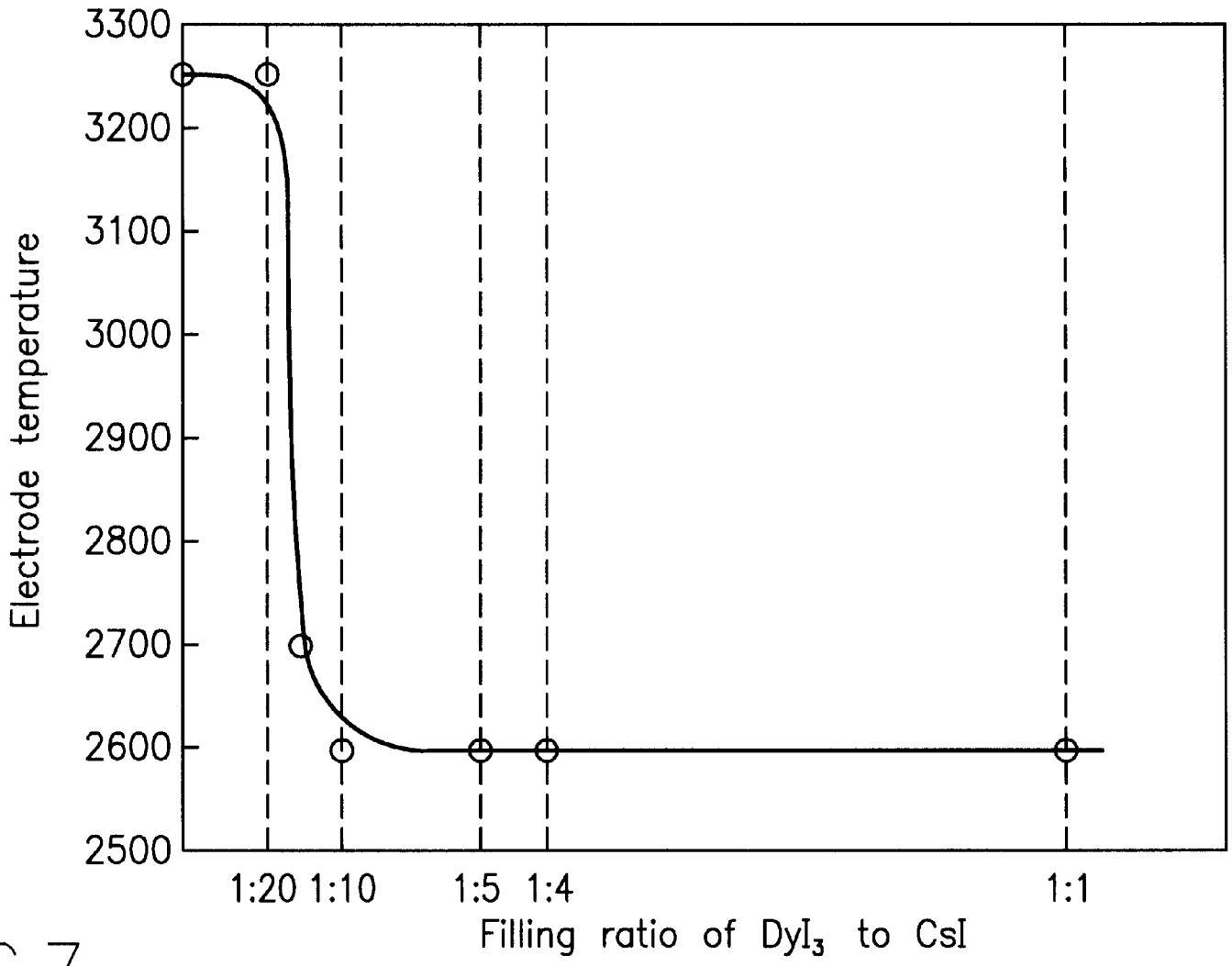
FIG. 7 is a graph showing the relation between the filling ratio of dysprosium iodide within the discharge vessel and the electrode temperature.

FIG. 7 schematically shows the result of the measurement in which the filling ratio of dysprosium iodide within the discharge vessel was changed and the relation between this filling ratio and the electrode temperature was measured. Here, it is shown that there are no longer any dysprosium atoms present which surround the electrodes and have the emitter function when the density of dysprosium atoms is reduced by increasing the filling ratio of the cesium iodide. Furthermore, it is shown that for a filling amount of dysprosium iodide to cesium iodide of less than 1/20, the degree of coating of the electrodes with the emitter atoms is finally roughly 0 degree and that the electrode temperature quickly rises. A rapid increase in electrode temperature shortens the service life of the discharge lamp. This shows that the filling amount of at least one halide of the first group to at least one halide of the second group must be greater than or equal to 1/20.

Figure 6:
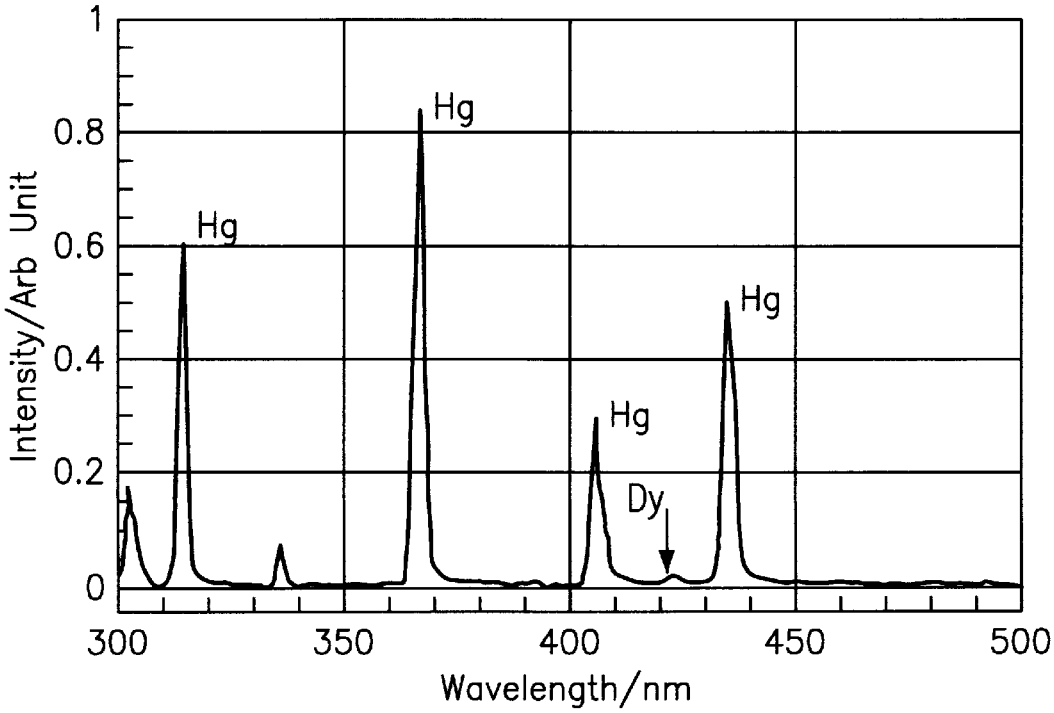
FIG. 6 shows an example of the spectrum of another high pressure mercury ultraviolet lamp in accordance with the invention.

FIG. 6 schematically shows, as another example of the invention, the same high pressure mercury ultraviolet lamp in which, however, the molar fraction ratio of dysprosium iodide to cesium iodide is 1:4. Here, there occurs an emission peak of dysprosium by which the emission intensity of the mercury decreases. The efficiency for this high pressure mercury ultraviolet lamp is not quite as good as in the prior example.

Figure 8:
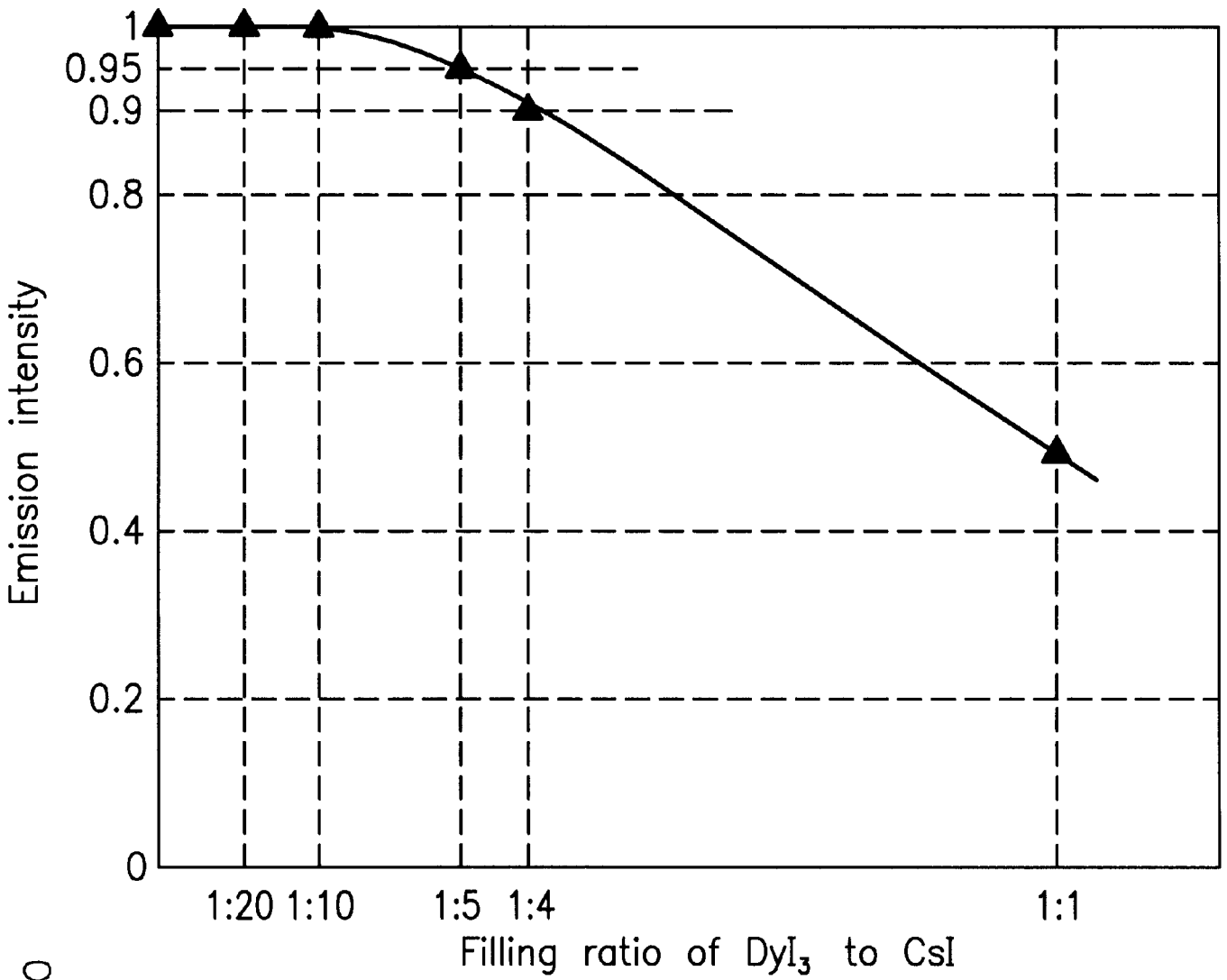
FIG. 8 is a plot of the relation between the filling ratio of dysprosium iodide within the discharge vessel and the emission intensity of the UV radiation with a wavelength of 365 nm.

FIG. 8 is a schematic of the relation between the filling ratio of dysprosium iodide within the discharge vessel and the emission intensity of the UV radiation with a wavelength of 365 nm. The emission intensity of the UV radiation with a wavelength of 365 nm plotted on the Y-axis is shown with comparison values in which the emission intensity of a high pressure mercury ultraviolet lamp at 365 nm is designated 1, for which there is no emission of the metal which forms the filled halide in a range with short wavelengths of less than or equal to 450 nm. When the filling ratio of dysprosium iodide is increased and the encapsulation amount of dysprosium iodide to cesium iodide is set to greater than 1/4, the emission intensity of mercury is reduced to less than 90%, the allowable limit which can be applied in practice as the high pressure mercury ultraviolet lamp. This shows that the filling amount of at least one halide of the first group to at least one halide of the second group must be less than or equal to 1/4.

When the filling amount of the at least one halide of the first group to the at least one halide of the second group is less than or equal to 1/5, at least 95% of the emission intensity at 365 nm can be ensured; this is even more advantageous since a high pressure mercury ultraviolet lamp with high efficiency can be obtained.

In this case, iodides were described by way of example as halides. However, other halides such as bromides, chlorides and the like or mixtures thereof can also be used.

In the lamp of the invention, in the case of choosing a dysprosium halide as the halide of the first group, it is advantageous to reduce the value which is obtained by dividing the emission intensity of the spectral line of the dysprosium atoms with a wavelength of 422.5 nm by the emission intensity of the mercury atoms with a wavelength of 404.6 nm in a steady operating state to less than or equal to 0.25, so that the emission intensity of mercury is at least at the allowable limit which can be applied in practice as the mercury ultraviolet lamp. When the filling ratio of the halide of dysprosium of the first group to the halide of the second group as the molar fraction has a value between 1:4 and 1:20, as was described above, the above described condition is satisfied.

Furthermore, in the lamp of the invention in which a halide of lanthanum was chosen as the halide of the first group, it is feasible to reduce the value which is obtained by dividing the emission intensity of the spectral line of the lanthanum atoms with a wavelength of 406.0 nm by the emission intensity of the mercury atoms with a wavelength of 404.6 nm in a steady operating state to less than or equal to 0.1, so that the emission intensity of mercury is at least at the allowable limit which can be applied in practice as the mercury ultraviolet lamp. If in doing so the filling ratio of the halide of lanthanum of the first group to the halide of the second group as the molar fraction has a value between 1:4 and 1:20, the above described condition is satisfied.

In addition, in the lamp of the invention in which a halide of gadolinium was chosen as the halide of the first group, it is feasible to reduce the value which is obtained by dividing the emission intensity of the spectral line of the gadolinium atoms with a wavelength of 402.8 nm by the emission intensity of the mercury atoms with a wavelength of 404.6 nm in a steady operating state to less than or equal to 0.15. If in doing so the filling ratio of the halide of the first group to the halide of the second group as the molar fraction has a value between 1:4 and 1:20, the above described condition is satisfied.

Furthermore, in the lamp of the invention in which a halide of cerium was chosen as the halide of the first group, it is feasible to reduce the value which is obtained by dividing the emission intensity of the spectral line of cerium atoms with a wavelength of 397.2 nm by the emission intensity of the mercury atoms with a wavelength of 404.6 nm in a steady operating state to less than or equal to 0.1. If in doing so the filling ratio of the halide of cerium of the first group to the halide of the second group as the molar fraction has a value between 1:4 and 1:20, the above described condition is satisfied.

Still further, in the lamp of the invention in which a halide of yttrium was chosen as the halide of the first group, it is feasible to reduce the value which is obtained by dividing the emission intensity of the spectral line of yttrium atoms with a wavelength of 410.2 nm by the emission intensity of the mercury atoms with a wavelength of 404.6 nm in a steady operating state to less than or equal to 0.15. If in doing so the filling ratio of the halide of yttrium of the first group to the halide of the second group as the molar fraction has a value between 1:4 and 1:20, the above described condition is satisfied.

Also, in a lamp of the invention in which a halide of thorium was chosen as the halide of the first group, it is feasible to reduce the value which is obtained by dividing the emission intensity of the spectral line of thorium atoms with a wavelength of 408.5 nm by the emission intensity of the mercury atoms with a wavelength of 404.6 nm in a steady operating state to less than or equal to 0.2. If in doing so the filling ratio of the halide of thorium of the first group to the halide of the second group as the molar fraction has a value between 1:4 and 1:20, the above described condition is satisfied.

In addition, with consideration of the current density as being the relation between the electrode diameter and the lamp current, the relation to lamp efficiency was checked. This showed that, at a current density of greater than 15 $A/mm^2$ as a result of the high electrode temperature, the base metal of the electrodes appears and that the effect of reducing the work function is reduced. Furthermore, it became apparent that at a current density of less than 3 $A/mm^2$, the radiance spots of the electrodes are concentrated in a single area of the electrode tip and that, therefore, the disadvantage of unstable discharge occurs.

If the value which is obtained by dividing the cross-sectional area in the direction perpendicular to the axial direction of the upholding parts of the electrodes is defined as the current density, the electrode radiance spots spread in an area in which the current density in a steady operating state is 3 $A/mm^2$ to 15 $A/mm^2$ over the entire surface of the electrode tips. It became apparent that at least one halide of the first group acts optimally as the emitter material, and that a lamp with a long service life is enabled.

The discharge vessel is usually too small when it has an inside volume of less than or equal to 2.5 $cm^3$. Here, production and processing of the vessel are difficult. In the conventional case of using quartz glass, processing is done by melting the glass, by which the dimensional accuracy often becomes low. If, however, the above described discharge vessel is formed from translucent aluminum oxide which has been produced by a sintering process or from a translucent ceramic such as YAG or the like, the advantage arises that dimensional accuracy is high and that a lamp with low scattering can be produced.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

Action of the Invention

As was described above, in accordance with the invention, a high pressure mercury ultraviolet lamp with an inside volume of less than or equal to 2.5 $cm^3$ is filled with at least one halide which is chosen from a first group of halides which consists of halides of yttrium, lanthanum, cerium, dysprosium, gadolinium and thorium and at least one halide chosen from a second group of halides which consists of halides of alkali metal elements, so that at least one halide of the above described first group acts as emitter material, with a filling ratio in the range from 1:4 to 1:20 relative to one another as a molar fraction, and the average evaluation index of color reproduction is fixed at less than or equal to 40.

For a small high pressure mercury ultraviolet lamp, this also yields the same action as the application of emitter material to the upholding parts of the electrodes. Furthermore, this prevents spraying of the emitter material during lamp operation. In this way, a reduction of the UV radiation transmission factor of the wall of the discharge vessel and shortening of the lamp service life are prevented.

Furthermore, the discharge vessel can be produced from translucent ceramic, by which high dimensional accuracy can be ensured in a high pressure mercury ultraviolet lamp which is smaller than one made of quartz glass.

In the high pressure mercury ultraviolet lamp of the invention, the lamp service life can be further increased by fixing the current density in the steady operating state in the range of 3 $A/mm^2$ to 15 $A/mm^2$ when the value obtained by dividing the lamp current by the cross-sectional area in the direction perpendicular to the axial direction of the upholding parts of the electrodes is called the current density.

What we claim is:

1. High pressure mercury ultraviolet lamp comprising a discharge vessel with an inside volume of less than or equal to 2.5 $cm^3$, a pair of electrodes disposed in said vessel together with mercury as a primary emission component; wherein at least one halide from a first group of halides which consists of halides of yttrium, lanthanum, cerium, dysprosium, gadolinium and thorium and at least one halide from a second group of halides which consists of halides of alkali metal elements are provided in said vessel; wherein said at least one halide of the first group acts as an emitter material; wherein a filling ratio of the at least one halide of the first group with respect to the at least one halide of the second group is in a range of from 1:4 to 1:20 as a molar fraction; and wherein an average evaluation index of color reproduction is at less than or equal to 40.

2. High pressure mercury ultraviolet lamp as claimed in claim 1, wherein the range of filling ratio of the at least one halide of the first group to the at least one halide of the second group is from 1:5 to 1:20.

3. High pressure mercury ultraviolet lamp as claimed in claim 1, wherein the discharge vessel is made of a translucent ceramic.

4. High pressure mercury ultraviolet lamp as claimed in claim 3, wherein the translucent ceramic is YAG.

5. High pressure mercury ultraviolet lamp as claimed in claim 1, wherein the at least one halide from the first group of halides comprises a halide of dysprosium; and wherein a value which is obtained by dividing an emission intensity of a spectral line of dysprosium atoms with a wavelength of 422.5 nm by an emission intensity of mercury atoms with a wavelength of 404.6 nm during steady state operation of the lamp is less than or equal to 0.25.

6. High pressure mercury ultraviolet lamp as claimed in claim 1, wherein the at least one halide from the first group of halides comprises a halide of lanthanum; wherein the value which is obtained by dividing the emission intensity of the spectral line of lanthanum atoms with a wavelength of 406.0 nm by the emission intensity of mercury atoms with a wavelength of 404.6 nm during steady state operation of the lamp is less than or equal to 0.1.

7. High pressure mercury ultraviolet lamp as claimed in claim 1, wherein the at least one halide from the first group of halides comprises a halide of gadolinium; wherein a value which is obtained by dividing the emission intensity of the spectral line of gadolinium atoms with a wavelength of 402.8 nm by the emission intensity of mercury atoms with a wavelength of 404.6 nm during steady state operation of the lamp is less than or equal to 0.15.

8. High pressure mercury ultraviolet lamp as claimed in claim 1, wherein the at least one halide from the first group of halides comprises a halide of cerium; wherein the value which is obtained by dividing the emission intensity of the spectral line of cerium atoms with a wavelength of 397.2 nm by the emission intensity of mercury atoms with a wavelength of 404.6 nm during steady state operation of the lamp is less than or equal to 0.1.

9. High pressure mercury ultraviolet lamp as claimed in claim 1, wherein the at least one halide from the first group of halides comprises a halide of yttrium; wherein the value which is obtained by dividing the emission intensity of the spectral line of yttrium atoms with a wavelength of 410.2 nm by the emission intensity of mercury atoms with a wavelength of 404.6 nm during steady state operation of the lamp is less than or equal to 0.15.

10. High pressure mercury ultraviolet lamp as claimed in claim 1, wherein the at least one halide from the first group of halides comprises a halide of thorium; wherein the value which is obtained by dividing the emission intensity of the spectral line of thorium atoms with a wavelength of 408.5 nm by the emission intensity of mercury atoms with a wavelength of 404.6 nm during steady state operation of the lamp is less than or equal to 0.2.

11. High pressure mercury ultraviolet lamp as claimed in claim 1, wherein a current density value obtained by dividing a lamp current by a cross-sectional area of the discharge vessel in a direction perpendicular to an axial direction of upholding parts of the electrodes is in a range of from 3 $A/mm^2$ to 15 $A/mm^2$ during steady operating state of the lamp.

12. High pressure mercury ultraviolet lamp as claimed in claim 11, wherein the discharge vessel is made of a translucent ceramic.

13. High pressure mercury ultraviolet lamp as claimed in claim 11, wherein the translucent ceramic is YAG.

14. High pressure mercury ultraviolet lamp as claimed in claim 13, wherein the at least one halide from the first group of halides comprises a halide of dysprosium; and wherein a value which is obtained by dividing an emission intensity of a spectral line of dysprosium atoms with a wavelength of 422.5 nm by an emission intensity of mercury atoms with a wavelength of 404.6 nm during steady state operation of the lamp is less than or equal to 0.25.

15. High pressure mercury ultraviolet lamp as claimed in claim 11, wherein the at least one halide from the first group of halides comprises a halide of lanthanum; wherein the value which is obtained by dividing the emission intensity of the spectral line of lanthanum atoms with a wavelength of 406.0 nm by the emission intensity of mercury atoms with a wavelength of 404.6 nm during steady state operation of the lamp is less than or equal to 0.1.

16. High pressure mercury ultraviolet lamp as claimed in claim 11, wherein the at least one halide from the first group of halides comprises a halide of gadolinium; wherein a value which is obtained by dividing the emission intensity of the spectral line of gadolinium atoms with a wavelength of 402.8 nm by the emission intensity of mercury atoms with a wavelength of 404.6 nm during steady state operation of the lamp is less than or equal to 0.15.

17. High pressure mercury ultraviolet lamp as claimed in claim 11, wherein the at least one halide from the first group of halides comprises a halide of cerium; wherein the value which is obtained by dividing the emission intensity of the spectral line of cerium atoms with a wavelength of 397.2 nm by the emission intensity of mercury atoms with a wavelength of 404.6 nm during steady state operation of the lamp is less than or equal to 0.1.

18. High pressure mercury ultraviolet lamp as claimed in claim 11, wherein the at least one halide from the first group of halides comprises a halide of yttrium; wherein the value which is obtained by dividing the emission intensity of the spectral line of yttrium atoms with a wavelength of 410.2 nm by the emission intensity of mercury atoms with a wavelength of 404.6 nm during steady state operation of the lamp is less than or equal to 0.15.

19. High pressure mercury ultraviolet lamp as claimed in claim 11, wherein the at least one halide from the first group of halides comprises a halide of thorium; wherein the value which is obtained by dividing the emission intensity of the spectral line of thorium atoms with a wavelength of 408.5 nm by the emission intensity of mercury atoms with a wavelength of 404.6 nm during steady state operation of the lamp is less than or equal to 0.2.

* * * * *